US006382536B1

(12) United States Patent
Lusty et al.

(10) Patent No.: US 6,382,536 B1
(45) Date of Patent: May 7, 2002

(54) ROTARY MINERAL BREAKER ROTOR BED CONTOURING

(75) Inventors: Andrew William Kevin Lusty, Matamata; Alan Mark Garvin, Cambridge, both of (NZ)

(73) Assignee: Svedala Barmac Limited, Matamata (NZ)

( * ) Notice: Subject to any disclaimer, the term of this patent is extended or adjusted under 35 U.S.C. 154(b) by 0 days.

(21) Appl. No.: 09/445,434

(22) PCT Filed: Jun. 4, 1998

(86) PCT No.: PCT/NZ98/00076

§ 371 Date: Mar. 3, 2000

§ 102(e) Date: Mar. 3, 2000

(87) PCT Pub. No.: WO98/56508

PCT Pub. Date: Dec. 17, 1998

(30) Foreign Application Priority Data

Jun. 11, 1997 (NZ) ..... 328062

(51) Int. Cl.[7] ..... B02C 19/00
(52) U.S. Cl. ..... 241/5; 241/275
(58) Field of Search ..... 241/5, 275

(56) References Cited

U.S. PATENT DOCUMENTS

| | | | |
|---|---|---|---|
| 2,992,783 A | 7/1961 | Wirth | 241/275 |
| 4,940,188 A | 7/1990 | Rodriguez et al. | 241/275 |
| 5,131,601 A * | 7/1992 | Okawa | 241/275 |

FOREIGN PATENT DOCUMENTS

| | | |
|---|---|---|
| AU | 61032 | 4/1975 |
| AU | 716034 | 3/1998 |
| NZ | 198307 | 4/1986 |
| NZ | 201190 | 7/1986 |
| NZ | 201418 | 8/1986 |
| NZ | 213510 | 2/1989 |
| NZ | 217753 | 2/1989 |
| NZ | 217752 | 12/1990 |
| WO | WO95/10358 | 4/1995 |
| WO | WO95/11086 | 4/1995 |
| WO | WO98/10359 | 3/1998 |

* cited by examiner

*Primary Examiner*—Mark Rosenbaum
(74) *Attorney, Agent, or Firm*—Jacobson Holman, PLLC

(57) ABSTRACT

A rotary mineral breaker of the type having a rotor (1) able to rotate about a substantially vertical axis. The rotor has an inlet for mineral pieces which are to be broken. The inlet is substantially parallel to the rotary axis when viewed from above. The rotor also has at least one peripheral exit port (9) for such materials, that is minerals after breaking, to exit radially of the rotor into a surrounding mineral material interaction zone (6). The rotor has a feature that at the or each peripheral port, but carried by the said rotor, there is means providing an exit port geometry which at least includes a mineral piece there to accumulation weir (3) to encourage by the appropriate profiling of the bed, those mineral pieces accelerating, in use, on the bed of retained mineral pieces (5) to exit over the weir (3) away from the upper regions of the retained bed (5).

13 Claims, 10 Drawing Sheets

ROTARY MINERAL BREAKER ROTOR BED CONTOURING

TECHNICAL FIELD

The present invention relates to improvements in and/or relating to mineral breakers and in particular (although not solely) the contouring of the rotor bed of such machines.

BACKGROUND OF THE INVENTION

Our mineral breaker was first disclosed in Australian Patent Specification No. 463819. Such a mineral breaker was revolutionary at the time since it embodied a system whereby a plurality of the mineral beds are defined within a rotating element (rotor) thus ensuring the majority of the wear (save for a hardened wear tip) is of mineral against mineral.

Enhancements of the original machine are disclosed in our New Zealand Patent Specification No. 198307 (AU 557168), 201190 (EPO 101277 and AU 562251), 201418, 213510, 217752, 217753, 222648 and 250027 (WO 95/11086).

Our New Zealand Patent Specification 201190 discloses an improvement whereby, as an enhancement, a hardened wear tip blade is mounted within a recess at the edge of a carrier which is to be positioned at a position where, in the manner of a weir, the smaller pieces of mineral overflow to exit the device.

U.S. Pat. No. 2,992,783 (Wirth et al) also show a mineral breaker of a kind having a substantially vertical axis feed into a rotor.

U.S. Pat. Specification No. 4,940,188 of J Rodriguez and D Rodriguez discloses yet a further refinement of the system. This U.S. Patent discloses the use of a weir member which acts substantially as a straight edged wear tip but which better manages the weir erosion.

New Zealand Patent Specification 248953 (WO 95/10358) Tidco International Limited discloses yet a further refinement of the weir tip aspects.

In our WO 95/111086 there is disclosed and claimed a variety of tip defining assemblies for inclusion in a rotor of such a mineral breaker, the weir-like edge being configured, assembled or otherwise arranged to provide a region of flow enhancement such that a greater depth of mineral pieces passes over that edge region favoured to be eroded and to retain a bed of material having a transverse surface conforming to the weir-like edge. Symmetric contours for such a weir-like edge are defined with the preferred forms being to a V, U or other scalloped configuration.

The full content of all of the aforementioned specifications is hereby here included by way of reference.

Attention is also drawn to our as yet unpublished New Zealand Patent Specification Nos. 299518 and 299299.

The present invention is directed to mineral breakers, sub-assemblies and operating procedures and methods when using such mineral breakers which provides at least an alternative to the rotor retained beds derivable from such prior art devices and preferably in a form that enhances a transition for pieces to be broken from (i) a flow stream substantially parallel to the rotor axis to (ii) the radial flow with respect to the rotor over the weir-like edge into a crushing surface defined by a retained mineral lining or bed impingement surface of a surrounding chamber or into a "crushing" zone (which may or may not involve passage of the mineral pieces to that surface through a cascade of a secondary or rotor bypassing feed of mineral pieces or through rebound or deflected pieces).

As used hereinafter reference to "crushing" embodies the breakage of materials (preferably minerals) by mineral to mineral impact and/or mutual abrasion.

Moreover whilst a rotor will be defined preferably with reference to three retained beds of mineral pieces in the rotor any number of such retained beds is within the scope of the present invention.

Likewise "mineral" can mean any material capable of breakage into pieces by mutual collisions.

Likewise "plate" is to be construed broadly to include any unitary or fabricated form whether spaced apart or not.

BRIEF SUMMARY OF THE INVENTION

Accordingly in a first aspect the present invention consists in

A rotary mineral breaker of a kind, having a rotor to rotate about a substantially vertical rotary axis, the rotor having an inlet for mineral pieces at and/or substantially parallel to the rotary axis thereof from above and at least one peripheral exit port for such materials to exit in the same and/or a modified form radially of the rotor into a surrounding mineral material interaction zone, the rotor being characterised in that at the or each peripheral port, but carried by said rotor, there is means providing an exit port geometry which at least includes a mineral piece bed accumulation weir to encourage, by appropriate profiling of the bed, those mineral pieces accelerating in use on the bed of retained mineral pieces to exit over the weir(s) away from the upper regions of the retained bed.

Preferably the or each weir favours material exiting at and/or below the mid point of the axial depth of the retained bed;

Preferably the or each weir favours material exiting at lower regions of each weir;

Preferably the bed associated with the or each peripheral port is further shaped by the provision of rotor carried means to provide a bed trailing geometry such that the retaining bed of the rotor is shaped between the bed trailing geometry and the exit port geometry to provide, by the profiling of the bed, a favoured curved locus for mineral piece movement upon entry in use into the rotor downwardly over the bed to the peripheral port;

Preferably each weir is asymmetric when considered in its vertical extent;

Preferably each weir includes at lease one sacrificial member carried by a member or assembly in turn carried by the rotor;

Preferably there are a plurality of peripheral ports.

Accordingly in another aspect the present invention consists in, in a rotary mineral breaker of the aforementioned kind, the use of a rotor to rotate about a substantially vertical rotary axis and having an inlet for mineral pieces substantially parallel to the rotary axis thereof from above (and preferably at or adjacent the rotary axis thereof) and having at least one peripheral exit port for such materials in the same or a modified form, the rotor being characterised in that at each peripheral port but carried by said rotor a member, structure or assembly defines a mineral piece bed accumulation weir for the rotor and said geometry thereof (exit port geometry) is such as to favour the exiting of mineral pieces in use over a retained bed of retained mineral pieces over an edge or edges of the geometry away from (when viewed in use) the upper regions of the retained bed.

Preferably said geometry is asymmetric.

Preferably said geometry is in the form of a plate or number of plates (preferably with hardened weir-like edges).

Preferably said edge favours material exiting at and/or below about the midpoint of the axial depth of the rotor port.

Preferably said rotor includes a member, structure or assembly to define a bed trailing geometry and the retained bed of the rotor is in each instance retained between the two geometries, ie; the trailing geometry and the exit port geometry.

Preferably the trailing geometry is such as to reduce the proximate retained bed at the upper regions of the axial depth of the rotor in favour of greater bed retention at the lower regions thereof Conversely preferably the exit port geometry does substantially the opposite.

Preferably the trailing geometry includes no hardened surfaces but preferably is configured so as to enhance bed accumulation and the tuning thereof to define the preferred locus of movement over the retained bed for mineral pieces that come into contact with the retained bed.

Preferably a favoured locus of mineral piece movement upon entry in use into the rotor downwardly is about a curve (preferably to exit adjacent lower regions of the retained bed).

In yet a further aspect the present invention consists in a rotary mineral breaker of a kind as previously set forth in any of its forms wherein a weir-like tip or tip assembly defines an overflow edge (at least part of which is to be sacrificed but which preferably is of a hardened material) wherein the weir-like surface is asymmetric and is attachable into the rotor so that the weir will have a reduced affect and thus favour overflow (preferably at lower regions of the rotor as against upper regions thereof).

Preferably said tip assembly is of any of the kinds previously defined but with pre-defined wear hardened elements embodied therein, thereon, etc., eg; tungsten carbide, etc.

Preferably the assembly is of any of the kinds previously set forth when modified to take into account the asymmetric requirement just mentioned or to take into account the preferred requirements thereof in respect of tuning a retained bed of a rotor in conjunction with a trailing geometry as previously set forth.

In still a further aspect the present invention consists in a rotary mineral crusher of any of the aforementioned kinds (whether to be operated with a single flow) through the rotor or as a dual flow (ie; through the rotor and separately cascaded down about the rotor) where embodied in the machine there is a rotor of the kind previously defined preferably with the weir-lie geometry defined at the outlet port(s) thereof or having a trailing geometry defined therein as previously defined, or both.

In preferred forms of the present invention preferably the rotor is provided with sufficient axial dimension to enable a smooth curving flow of mineral pieces to pass through the device.

Preferably said rotor embodies a circular or equivalent plate (preferably not having a stepped down periphery thereof but which may be stepped once or several times down to enhance such an effective depth to facilitate a curved flow path for mineral pieces) and which preferably has a central cone or the like, the apparatus being operable such that in use mineral pieces flow down into the spinning rotor and follow a favoured locus of movement over the (or each) retained bed over the weir-like exit port geometry of the (or each) bed.

In still a further aspect the invention consists in a rotary mineral breaker of a kind having a multiple bed carrying rotor that has an infeed at least substantially centrally from above substantially parallel to the rotation axis of the rotor where means is provided to effect bed contouring to a sacrificial weir-like effect structure, assembly or the like is achieved to define a preferred mineral piece curving locus of migration determined by contouring of the bed surface transverse to said locus, said curving locus passing over a predetermined wear resistant part of said sacrificial structure.

In still a further aspect the present invention consists in a weir-like geometry (whether defined as an assembly or an assemblage of components or whether unitarily defined or otherwise fabricated) where the effective sacrificial weir-like surfaces thereof favour movement over the sacrificial surface at lower regions of the rotor with respect to its vertical axis.

Preferably the assembly can take any of the forms previously described by reference to prior art wear tip assemblies.

In still a further aspect the present invention consists in a method of operating a rotary mineral breaker which comprises feeding mineral pieces to be crushed into the rotor of such a mineral breaker and by appropriate assembly of the bed retaining geometries at the exit port and at the trailing region of the retained bed defining a valley like surface of retained mineral pieces that curves downwardly and outwardly to the favoured exit region or regions of the weir-like edge of the exit port.

Preferably said method is performed using any of the apparatus previously defined.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF DRAWINGS

Preferred forms of the present invention will now be described with reference to the accompanying drawings in which.

DETAILED DESCRIPTION

Figure 1:
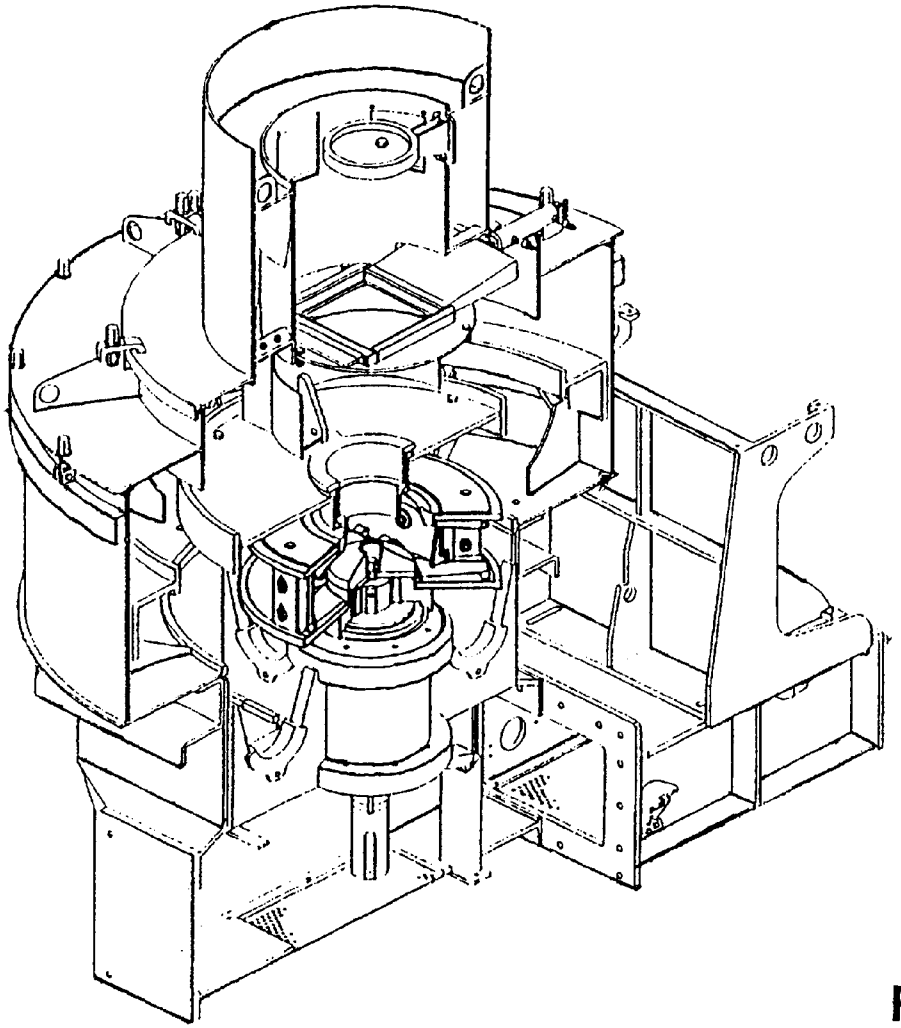
FIG. 1 shows a cut away perspective drawing of a rotary mineral breaker of the kind hitherto manufactured and sold by us under our BARMAC™, FIG. 1 showing a vertical and straight weir-like edge at the exit ports which provides a widespread of mineral piece out-feed from the rotor into the crushing zone defined in part by a retained bed within a surrounding chamber that is stationery with respect to the rotor (which moves at high speed), the pieces being thrown outwardly from the rotor impacting such a stationery bed (optionally through a cascading or deflected interference flow) prior to smaller pieces falling downwardly from the surrounding chamber.

FIG. 1 depicts with an exploded view a cutaway of a typical BARMAC™ machine. This type of rotary mineral breaker includes in preferred forms provision for a secondary flow that bypasses the rotor notwithstanding the fact that a majority of the infeed flow passes substantially axially down into the rotor to migrate over retained beds disposed within the rotor. The material leaves the rotor at high speed to then enter an impingement or crushing zone bounded by a structure that retains a static bed of material. From that zone material sufficiently broken down moves downwardly.

As described hereinafter the rotor preferably is formed on a substantially planar plate 1 having preferably centrally thereof at least a conical or frustoconical deflection member 2 which is symmetrically positioned on the rotation axis of the rotor.

In other forms of the present invention in order to provide a sufficient depth of rotor for the preferred curved locus of migration the outer regions of the plate 1 (whether unitary or fabricated) can be stepped down thus leading to the prospect of a lesser depth of weir-like structure about the exit ports of the rotor.

Figure 3A:
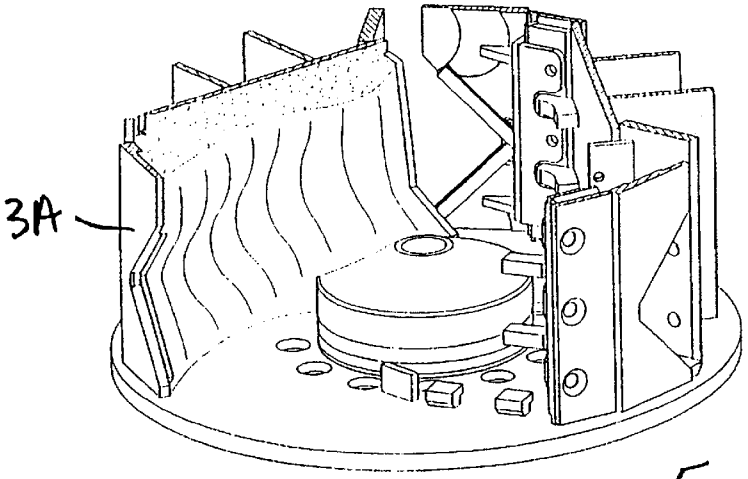
FIG. 3A is different variant to that of FIG. 2 to the extent that whilst the trailing edge region may be the same as that of FIG. 2 (it likewise can be varied) the exit port where defines an edge which whilst still asymmetric (as preferred) favours an accumulation and overflow of materials below a greater accumulation of mineral pieces of the retained bed thereabove.
Figure 2:
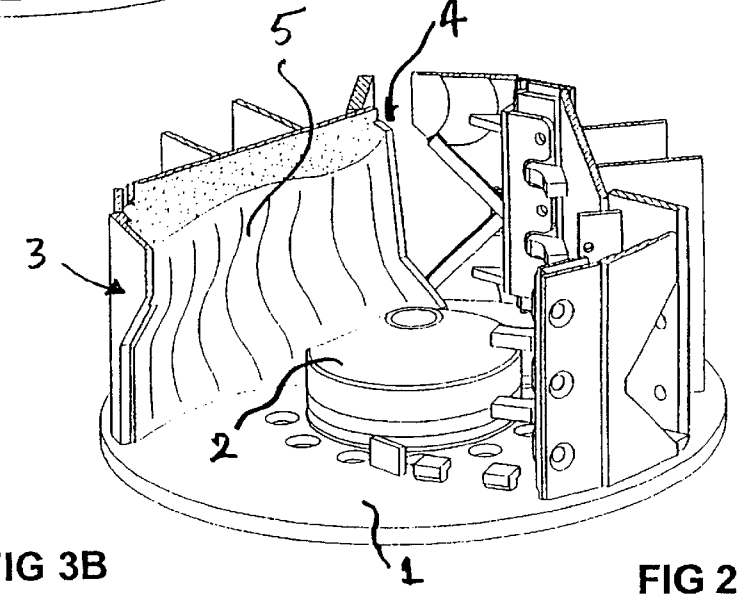
FIG. 2 is a view similar to that of the rotor in FIG. 1 but showing in detail one of the retained beds thereof (preferably one of the three retained beds thereof) the retained bed being on preferably a plate and preferably inwardly of a mineral piece deflection cone (frustoconical or otherwise), the retained bed being tuned to provide a favoured locus of movement for mineral pieces to be thrown outwardly of the rotor by the use, at the exit port and at the trailing region of the retained bed, of asymmetric means that favours at the trailing region a greater accumulation of mineral pieces at lower regions thereof and at the exit port a greater accumulation of mineral pieces at upper regions thereof, the valley preferably spiralling downwardly to provide for a smoother flow to the sacrificial edge defining the weir-like edge.
Figure 3B:
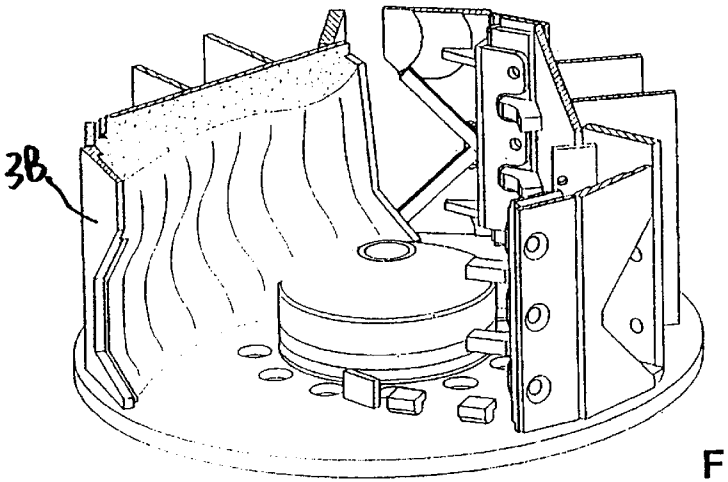
FIG. 3B is another variant to the arrangement of FIGS. 2 and 3 again showing a different variation for the weir-like geometry at the exit port.
Figures 4A, 4B, 4C, 4D, 4E, 4F:
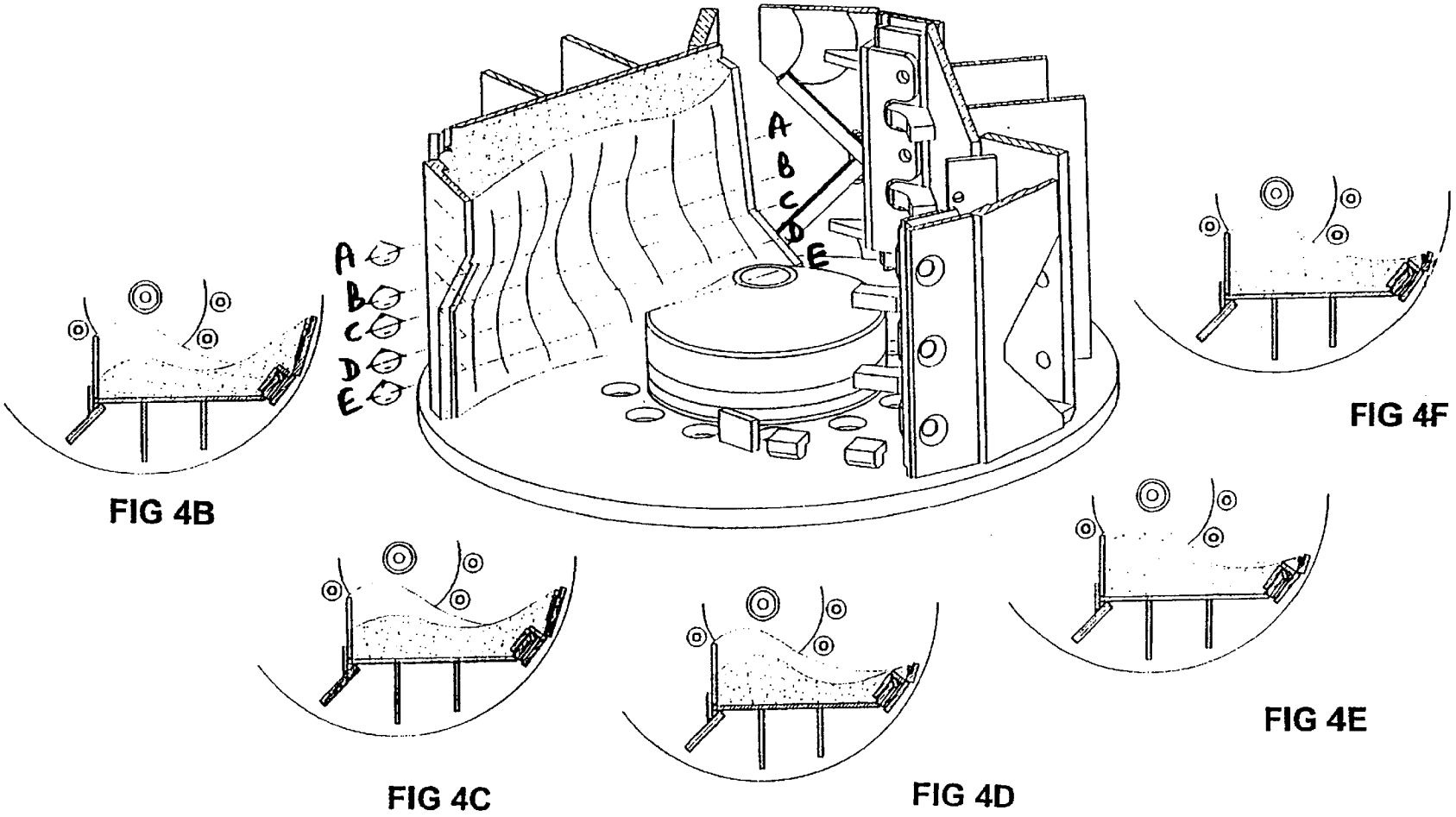
FIG. 4A is a similar view to that of FIG. 2 but showing the sections at A through E shown respectively in FIGS. 4B through 4F.

As shown in FIG. 2 and correspondingly shown in FIGS. 3A and 3B (there is the assembly 3 that provides the weir-like structure providing the geometry for contouring the bed from the sacrificial exit regions thereof whilst correspondingly there is the structure 4 which trails the bed.

Figure 11:
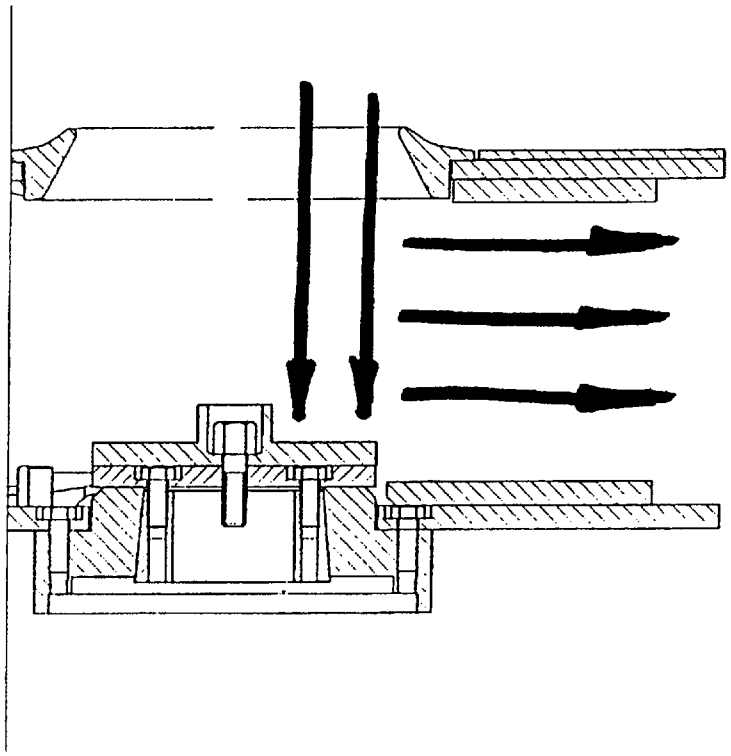
FIG. 11 is a similar view to that of FIG. 10 but showing how (unlike the situation in FIG. 10 where the energy the material has gained in falling into the rotor has been used to turn it) instead the energy is wasted by impacting the distributor plate and requires the energy derived from the rotor to move the material outwards.
Figure 10:
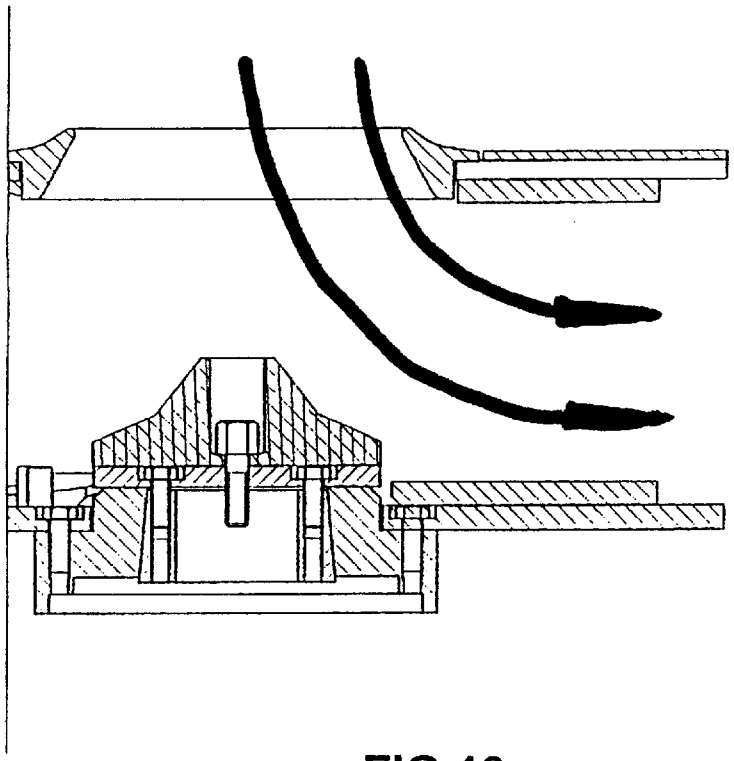
FIG. 10 shows what the rotor retained bed contouring does to the flow of material when considered in just the vertical plane.

The exact construction of at least one preferred form of each of the geometries 3 and 4 is depicted by reference to FIGS. 10 and 11 respectively which shows appropriate means whereby there can be at least a primary sacrificial zone hardened by appropriate provision of tungsten carbide or other wear resistant material and the capability of fixing such a wear tip with replacement parts from time to time as required. As in some of the prior arts patent specifications referred to various carries and back up sacrificial yet hardened edge forming means can be provided. Similarly but without the need for the hardening the trailing geometry.

Figure 7:
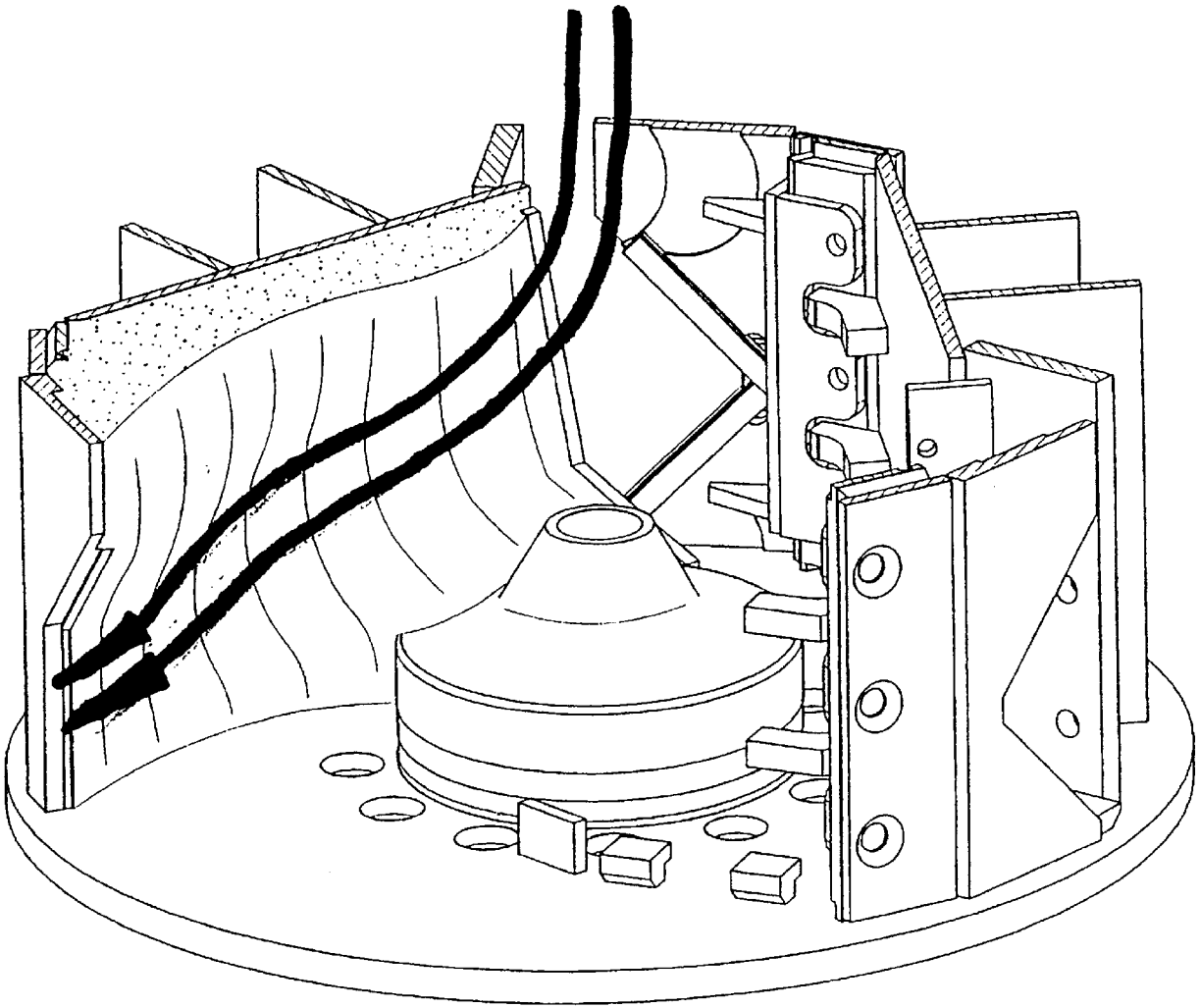

A bed 5 formed between the assemblies 3 and 4 respectively is contoured owing preferably to the favouring of a contour near the exit region of the rotor which favours movement on the contour towards the bottom of the rotor whilst conversely the opposite is achieved by the trailing edge. This can best be seen by reference to migration locus which is a curve depicted best by reference to FIG. 7 and shown in greater detail by use of the sections in FIGS. 4A through 4F.

Figure 8:
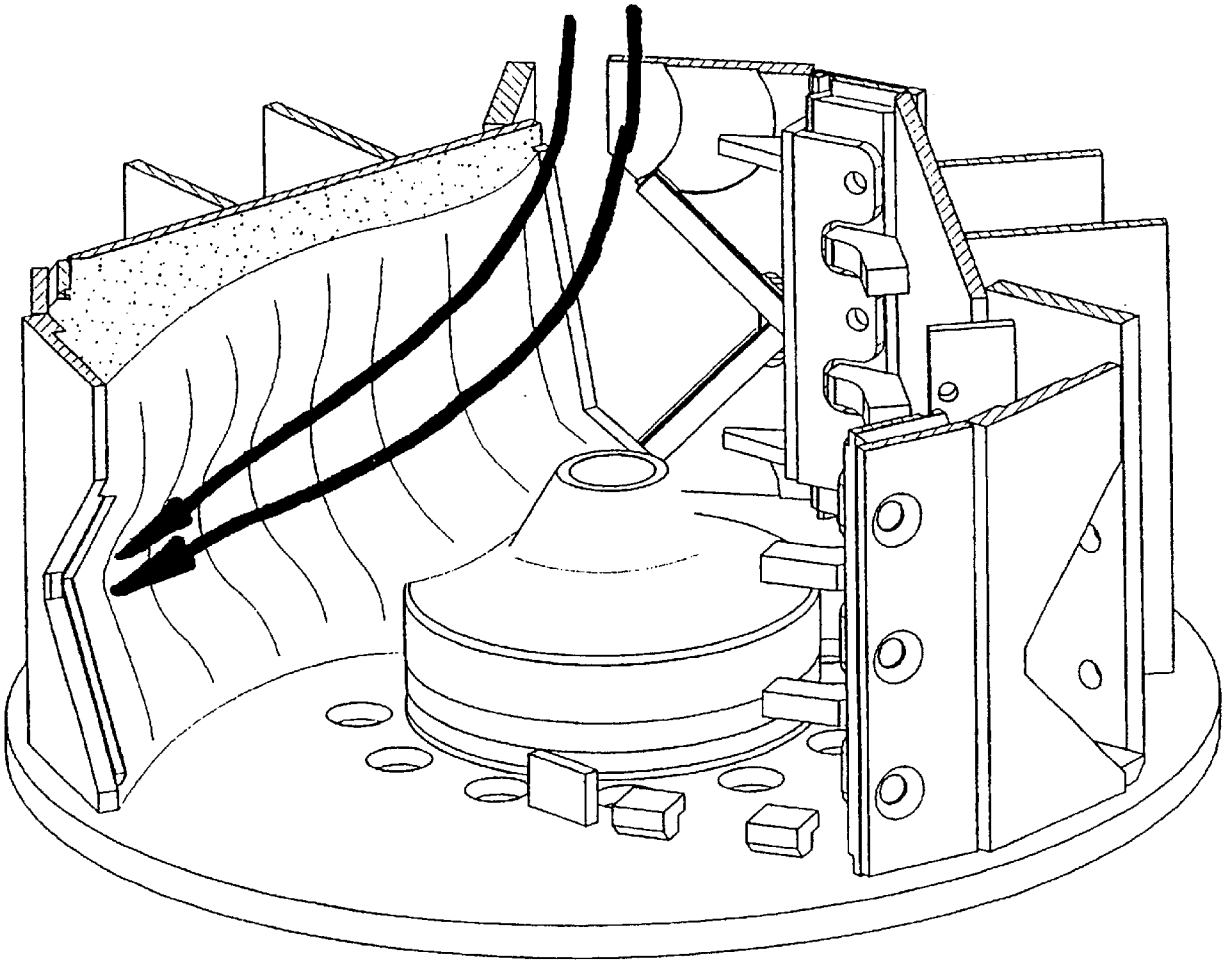
Figure 9:
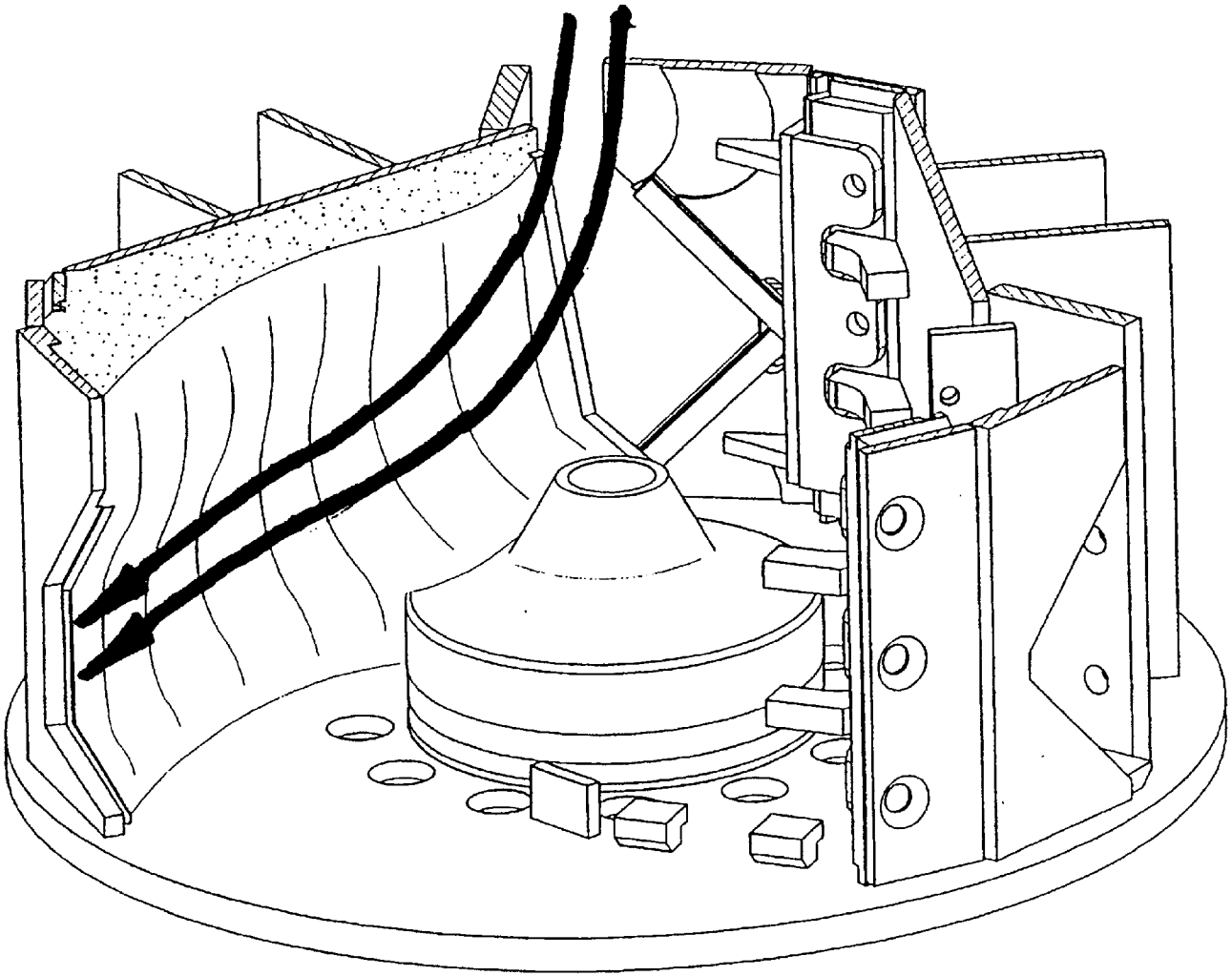

Other variants of the arrangement depicted by reference to III are shown by reference IIIA and IIIB respectively in FIGS. 3A and 3B respectively. The corresponding migration occurs for these variations are shown respectively in FIGS. 8 and 9.

The operation of the device will now be described with reference to the arrangement as shown in FIG. 1 but using a rotor of the kind typified by the at least partial rotor assembly shown in FIG. 2.

Figure 5:
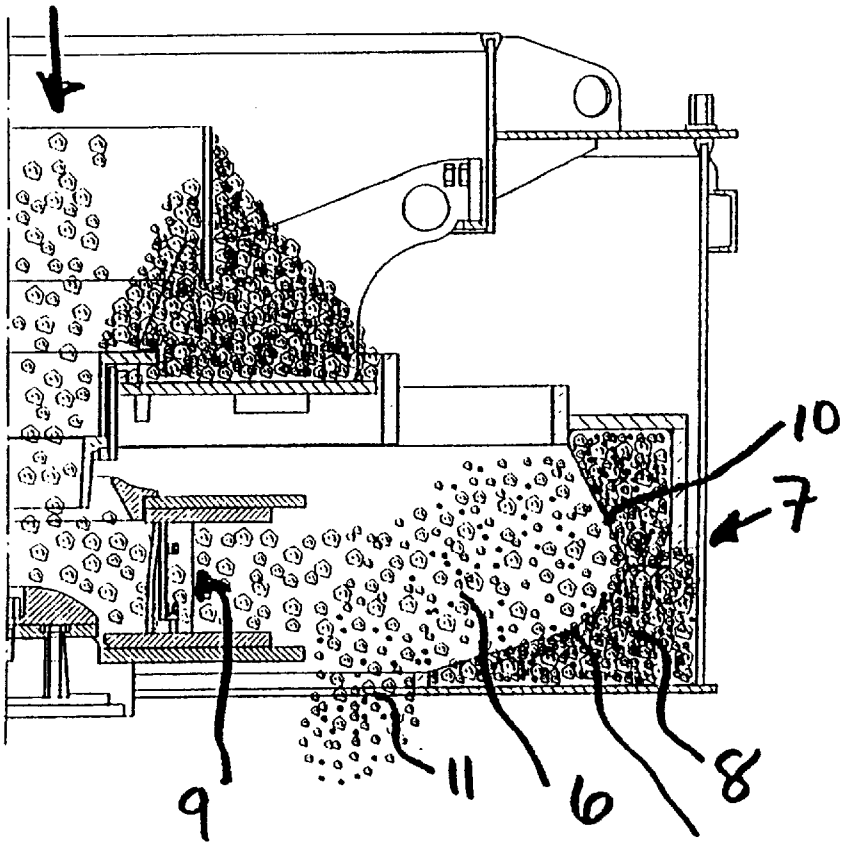
FIG. 5 is a partial sectional and elevation view of apparatus as shown in FIG. 2 (insofar as the rotor is concerned) when embodied as the rotor in an assembly (such as depicted in FIG. 1), FIG. 5 showing to the left the downward infeed in a known way of mineral pieces to be accelerated rapidly outwardly by the rotor and to flow outwardly into the breaking chamber defined in part by preferred stationery retained bed of pieces in the surrounding chamber.

With such an arrangement a flow as shown in FIG. 5 occurs. The mineral pieces pass in the arrowed direction downwardly in to the conveyor to then move about the predetermined migration locus as depicted by the arrows in FIG. 7 prior to exiting in to the breaking chamber 6 defined by the static structure 7 which in a known way contains and profiles a bed 8 of mineral pieces. The breaking zone 6 is therefore bounded by the exit port 9 of the rotor and the surface 10 of the static bed 8 within the crushing zone 6 therefore several types of interaction occur i) high energy pieces passing from the rotor directly impinge the surface 10, ii) high energy pieces from the rotor directly impinge rebounding mineral pieces or deflected mineral pieces away from the surface 10 and iii) mineral pieces of lesser energy than those directly incident from the rotor may impact each other and/or the surface 10.

Figure 6:
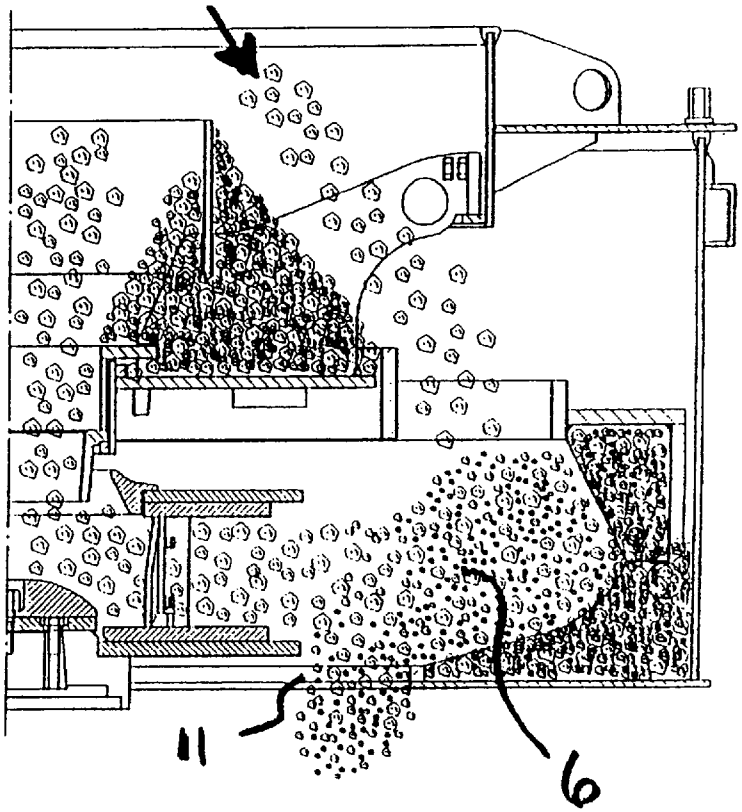
FIG. 6 is a similar view to that of FIG. 5 but showing the optionally operation of a secondary flow which is cascaded into the breaking chamber without passing through the rotor, such a secondary flow providing, by way of example, with say a 10% by passing of the rotor for greatly enhanced interactions of particle pieces in the breaking zone between the rotor and the retained stationery bed, FIGS. 7 through 9 (corresponding to FIGS. 2 through 3B) show preferred flowpaths, allowing material to flow more easily through rotor

FIG. 6 shows a variation to the arrangement of FIG. 5 where in addition to all of the interactions just discussed a bypass flow in the arrow direction shown in FIG. 6 is additionally provided. If, for example, up to 10% of the overall infeed flow is provided interactions within the crushing zone 6 is greatly enhanced since added to the possible interactions previously referred to there is in addition the prospect of iv) interaction of any of the pieces mentioned in interactions of kinds (i) through (iii) or the products thereof with the infeed flow or any broken down product thereof.

In each of the instances (FIG. 5 and FIG. 6 modes of operation) material of the desired state exits from the crushing zone 6 downwardly via an annular exit 11.

The arrangements described hereinafter in relation to the assemblies of the exit and trailing geometry of each rotor carried retained bed can be understood by reference to New Zealand Patent Specification Nos. 248953, 248952, 248955 and 248954, the fill content of which is hereby here included by way of reference. Nevertheless FIGS. 10 and 11 show arrangement for the exit geometries of a kind contemplated showing how a base plate structure can be utilised to erect an exit structure (e.g. tip assembly).

Figure 12B:
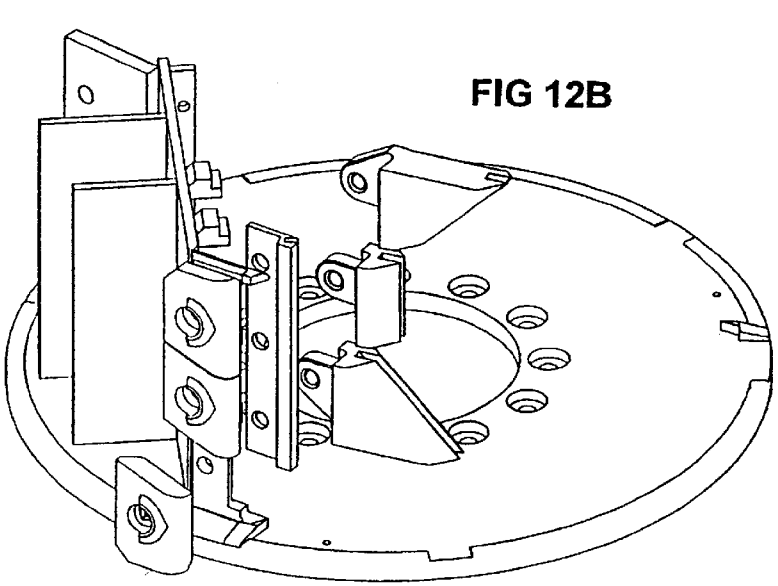
FIG. 12B is a similar view to that of FIG. 12A showing more of the assembly but in this instance showing secondary tip to back the elements depicted in FIG. 12A should there be a breakthrough of any one of them.
Figure 12A:
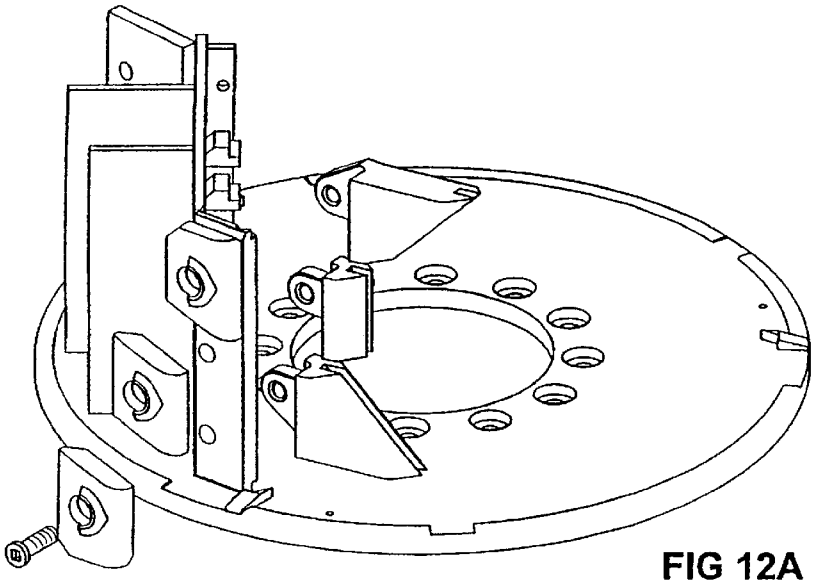
FIG. 12A is a perspective view of a base plate of a rotor assembly showing in a partly exploded view a bed training frame and projecting means from whence a trailing tip or the equivalent can be mounted (not shown) and showing at the zone for the particular bed retaining structure carriers and sacrificial elements of the tip assembly, the tip assembly in this instance being shown in three parts and showing recesses into which abrasion resistant materials, e.g. tungsten carbide strips can be fitted.
Figure 12G:
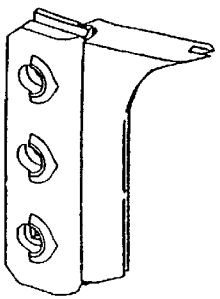
FIG. 12C shows one tip assembly in accordance with the present invention.
FIG. 12D shows the opposite arrangement to that of FIG. 12C.
FIG. 12E shows the arrangement as shown in FIGS. 12A and 12B.
FIG. 12F shows a variation of the arrangement of FIG. 12E where both the carriers mounts etc. as well as the tip itself can if desired be each in a single piece, FIG. 12G bears a relationship to the assembly of FIG. 12C similar to that which FIG. 12F bears to FIG. 12E.
Figure 12F:
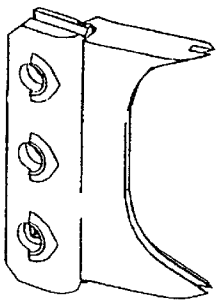
Figure 12E:
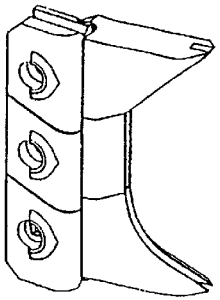
Figure 12D:
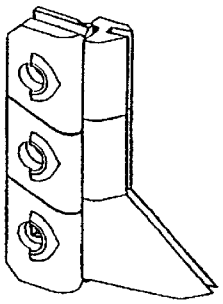
Figure 12C:
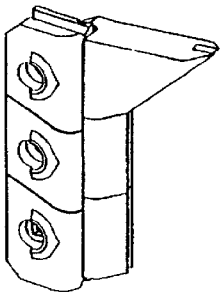
Figure 13:
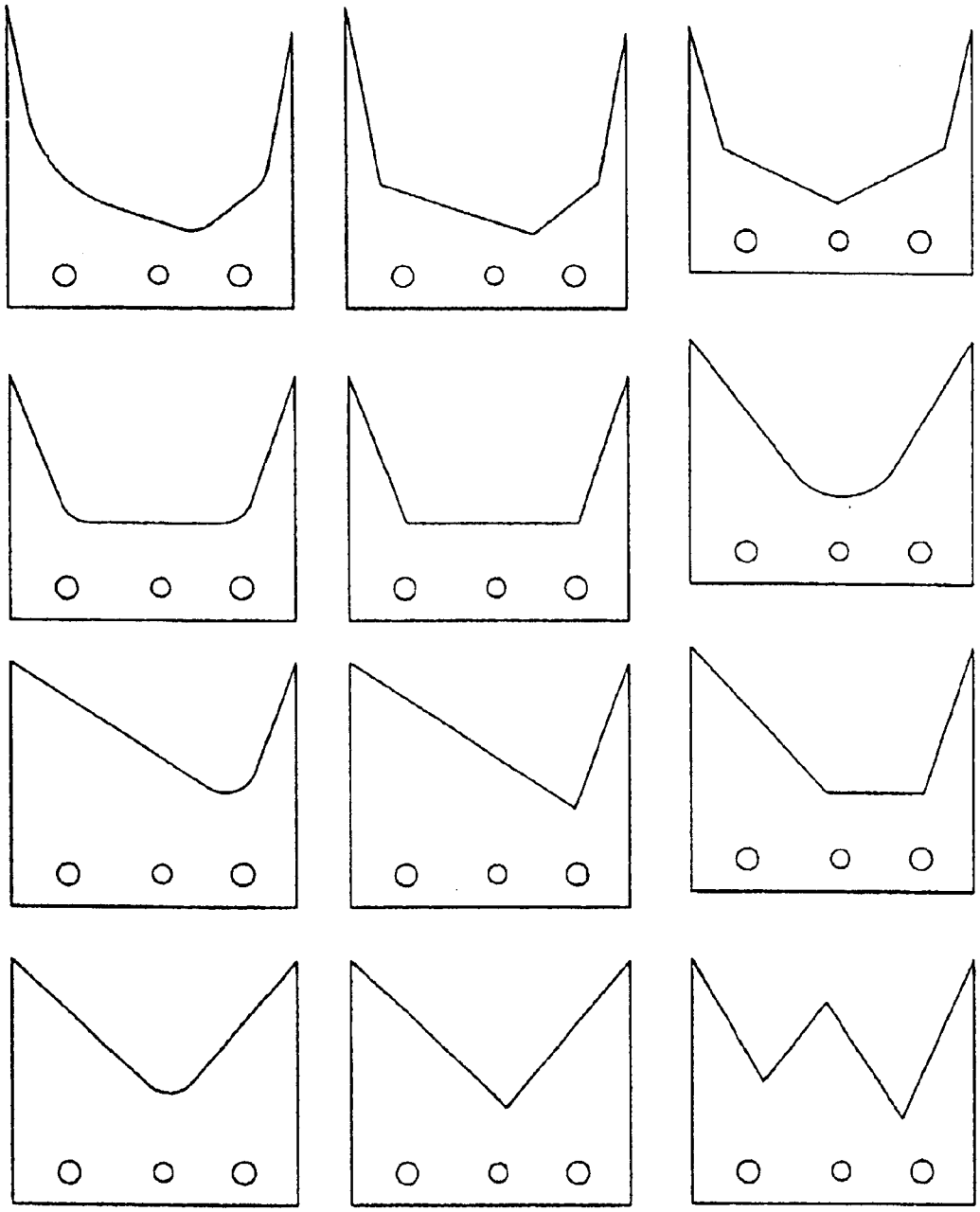
FIG. 13 shows the diverse and unrestricted nature of tip profiles possible that still fall within the scope of the present invention and which can if desired be used for bed contouring and the selective focusing of output from the rotor.

Persons skilled in the art will appreciate how the same supporting structure from the base plate for that particular bed retaining assembly depicted fin part in FIGS. 12A and 12B can also be utilised to provide the trailing geometries and that such arrangements may likewise be assembled.

Persons skilled in the art will appreciate that the exit tip assembly can have any of the profiles or any of the variants shown or be hybrids thereof or any of the prior art forms. For example, FIG. 12B shows a three part sacrificial structure each to carry its own segment of the edge forming tungsten carbide or the equivalent abrasion resistant material (not shown) but each being dependent from a structure as shown having interposed therebetween a further strengthened edge (as we have previously disclosed) where a break through of the primary weir tip leads to reliance upon a secondary weir tip prior to significant damage being done to the rotor and the components thereof necessary for a quick reconditioning thereof.

Persons skilled in the art will appreciate how such assembly arrangements can be utilised for both the exit and trailing geometries, the essence of the invention are the features described previously with regard to flow encouragement which minimises reliance on solely the rotor energy to move the infed materials outwardly, i.e. as described in conjunction with FIG. 10 there is a reliance upon the kinetic energy derived from the falling of the material into the rotor.

What is claimed is:

1. A rotary mineral breaker having a rotor to rotate about a substantially vertical rotary axis, the rotor having an inlet for mineral pieces at and/or substantially parallel to the rotary axis thereof from above and at least one peripheral exit port for such materials to exit in a same and/or a modified form radially of the rotor into a surrounding mineral piece interaction zone, and at the or each peripheral port, but carried by said rotor, there is means providing an exit port geometry, which geometry at least includes a mineral piece bed accumulation weir, to encourage, by appropriate profiling of the bed, those mineral pieces accelerating in use on the bed of retained mineral pieces to exit over the at least one weir away from the upper regions of the retained bed, the bed associated with the or each peripheral port being further shaped by a provision of rotor carried means to provide a bed trailing geometry such that the retaining bed of the rot or is shaped between the bed trailing geometry and the exit port geometry to provide, by the profiling of the bed, a favored curved locus for mineral piece movement upon entry in use into the rotor downwardly over the bed to the peripheral port.

2. A breaker as claimed in claim 1 wherein the or each weir favours material exiting at and/or below the mid point of the axial depth of the retained bed.

3. A breaker of claim 1 wherein the or each weir favours material exiting at lower regions of each weir.

4. A breaker of claim 1 wherein each weir is asymmetric when considered in its vertical extent.

5. A breaker of claim 4 wherein each weir includes at lease one sacrificial member carried by a member or assembly in turn carried by the rotor.

6. A breaker of claim 1 wherein there are a plurality of peripheral ports.

7. A method of operating a rotary mineral breaker having a rotor to rotate about a substantially vertical rotary axis, the rotor having an inlet for mineral pieces at and/or substantially parallel to the rotary axis thereof from above and at least one peripheral exit port for such materials to exit in a same and/or a modified form radially of the rotor into a surrounding mineral piece interaction zone, and at the or each peripheral port, but carried by said rotor, there is means providing an exit port geometry, which geometry at least includes a mineral piece bed accumulation weir, to encourage, by appropriate profiling of the bed, those mineral pieces accelerating in use on the bed of retained mineral pieces to exit over the at least one weir away from the upper regions of he retained bed, said method comprising:

feeding mineral pieces to be crushed into the rotor of a mineral breaker having previously, by appropriate assembly of the bed retaining geometry at each exit port and at the trailing region for each retained bed, defined a valley surface of retained mineral pieces that curves downwardly and outwardly to the favoured exit region or regions of the weir edge of the exit port.

8. A rotary mineral breaker having a rotor to rotate about a substantially vertical rotary axis, the rotor having an inlet for mineral pieces at and/or substantially parallel to the rotary axis thereof from above and at least one peripheral exit port for such materials to exit in the same and/or a modified form radially of the rotor into a surrounding mineral piece interaction zone, at the or each peripheral port, but carried by said rotor, there is means providing an exit port geometry, which geometry at least includes a mineral piece bed accumulation weir, for the or each peripheral port there is carried by the rotor means to provide a trailing geometry for each accumulated mineral piece bed of its associated accumulation weir, and the exit port geometry with its mineral piece bed accumulation weir and said associated bed trailing geometry in use co-act to contour the bed of accumulated mineral pieces such that there is a favored smooth curved acceleration locus defined by the bed for mineral piece movement from downward entry onto a high inward zone of the bed to an exit outwardly over the at least one weir below the level of the high inward zone of the retained bed.

9. A breaker as claimed in claim 8, wherein the or each mineral piece bed accumulation weir favors material exiting at or below a mid point of an axial depth of the retained bed.

10. A breaker as claimed in claim 8, wherein the or each weir is asymmetric when considered in its substantially vertical extent.

11. A breaker as claimed in claim 8, wherein each mineral piece bed accumulation weir includes at least one sacrificial member carried by a member or assembly in turn carried by the rotor.

12. A breaker as claimed in claim 8, wherein there are a plurality of peripheral ports.

13. The use of a rotary mineral breaker having a rotor to rotate about a substantially vertical rotary axis, the rotor having an inlet for mineral pieces at and/or substantially parallel to the rotary axis thereof from above and at least one peripheral exit port for such materials to exit in the same and/or a modified form radially of the rotor into a surrounding mineral piece interaction zone, at the or each peripheral port, but carried by said rotor, there is means providing an exit port geometry, which geometry at least includes a mineral piece bed accumulation weir, for the or each peripheral port there is carried by the rotor means to provide a trailing geometry for each accumulated mineral piece bed of its associated accumulation weir, and the exit port geometry with its mineral piece bed accumulation weir and said associated bed trailing geometry in use co-act to contour the bed of accumulated mineral pieces such that there is a favored smooth curved acceleration locus defined by the bed for mineral piece movement from downward entry onto a high inward zone of the bed to their exit outwardly over the at least one weir below the level of the high inward zone of the retained bed, the use of the rotary mineral breaker comprises rotating said rotor in an operational direction whilst dropping at least some of a source of the mineral as pieces to be reduced in size onto any high inward zone of the rotor from above.

* * * * *